United States Patent [19]

Sieghartner et al.

[11] 4,299,536

[45] Nov. 10, 1981

[54] MULTI-STAGE PUMPS

[75] Inventors: Leonard J. Sieghartner, Coal Valley; Larry Barnhouse, Keithsburg, both of Ill.

[73] Assignee: Roy E. Roth Company, Rock Island, Ill.

[21] Appl. No.: 65,126

[22] Filed: Aug. 9, 1979

[51] Int. Cl.[3] ..... F04D 29/52

[52] U.S. Cl. ..... 415/198.2; 415/199.6

[58] Field of Search ..... 415/199.4, 199.5, 199.6, 415/213 T, 219 R, 198.2, 198.1, 196, 199.2, 199.3

[56] References Cited

U.S. PATENT DOCUMENTS

| | | | |
|---|---|---|---|
| 863,706 | 8/1907 | Enke | 415/199.2 X |
| 1,130,422 | 3/1915 | Mueller | 415/199.2 |
| 2,204,857 | 6/1940 | Hollander | 415/199.2 |
| 3,103,892 | 9/1963 | McFarland | 415/199.3 X |
| 3,518,021 | 6/1970 | Lake et al. | 415/213 T |
| 3,661,474 | 5/1972 | Sieghartner | 415/198.2 X |
| 3,801,217 | 4/1974 | Ryall et al. | 415/199.2 |
| 3,963,371 | 6/1976 | Sieghartner | 415/213 T X |

*Primary Examiner*—Leonard E. Smith

*Attorney, Agent, or Firm*—Emrich, Root, Lee, Brown & Hill

[57] ABSTRACT

A multi-stage pump embodying an inner housing of modular construction and embodying a plurality of axially aligned casing rings having impellers rotatably mounted therein, the casing rings being removably mounted relative to each other and, together with the impellers disposed therein, each comprising a respective stage for the pump, with an outer housing mounted around the inner housing, in spaced, surrounding relation thereto to thereby afford an annular space between the inner and outer housings, with end sections being releasably secured to opposite ends of the outer housing in position to clamp the modules of the inner housing together, and with a passageway through the pump being afforded by the casing rings, the impellers, a radial opening through one end of the inner housing, the space between the inner and outer housings, a radial opening through the outer housing and a connector in communication with the last mentioned opening.

A modified form of the invention embodies a booster section for feeding liquid to the aforementioned inner housing.

22 Claims, 4 Drawing Figures

MULTI-STAGE PUMPS

BACKGROUND OF THE INVENTION

This invention relates to multi-stage pumps and, more particularly, to multi-stage pumps wherein the stages thereof are embodied in an inner housing that is encapsulated in an outer housing.

It is a primary object of the present invention to afford a novel, multi-stage pump.

Another object of the present invention is to afford a novel multi-stage pump, which embodies an outer housing disposed around the stages thereof, in outwardly spaced relation thereto, to afford a chamber between the outer housing and the stages, which chamber forms a portion of the discharge or outlet passageway of the pump.

Another object of the present invention is to afford a novel, multi-stage pump of the aforementioned type, wherein, during operation of the pump, fluid is fed into the aforementioned chamber at a pressure effective to substantially equalize the pressures internally and radially outwardly of the stages of the pump.

Another object of the present invention is to afford a novel multi-stage pump of the aforementioned type, which is effective to pump liquids, such as, for example, liquified gases, at or near the boiling points thereof, as well as being effective to pump other liquids, such as, for example, water.

Multi-stage pumps for pumping liquids, at or near the boiling points thereof, have been heretofore known in the art, being shown, for example, in U.S. Pat. No. 2,875,968, issued to L. C. Roth, on Mar. 3, 1959, and the earlier U.S. Pat. No. 3,963,371, issued to L. J. Sieghartner, on June 15, 1976, and the copending application for U.S. Letters Patent, Ser. No. 935,604, filed in the U.S. Patent and Trademark Office on Aug. 21, 1978, by said L. J. Sieghartner, one of the above named co-inventors of the present invention. Such pumps have been highly successful. It is an important object of the present invention to afford improvements over the multi-stage pumps heretofore known in the art.

Yet another object of the present invention is to afford a multi-stage pump wherein liquid enters an inner housing and is discharged from an outer housing which is disposed around the inner housing in a novel and expeditious manner.

An object ancillary to the foregoing is to afford a novel multi-stage pump of the aforementioned type, wherein the liquid being discharged from the pump passes into the area between the inner and outer housing in such a manner as to surround at least a portion of the stages of the pump so as to tend, at least, to equalize the pressures in, and the external pressures radially surrounding the surrounded stages.

Another object of the present invention is to afford a novel multi-stage pump of the aforementioned type which is modular in construction, and which is constructed in such a manner that the various stages thereof may be readily assembled and separated, relative to each other.

A further object of the present invention is to afford a novel multi-stage pump of the aforementioned modular type wherein the internal and external pressures relative to the modules are balanced in a novel and expeditious manner effective to afford protection against leakage of liquid outwardly between the modules thereof.

Another object of the present invention is to afford a novel multi-stage pump, having the aforementioned modular construction, wherein modules thereof are encapsulated in a novel and expeditious manner.

Another object of the present invention is to afford a novel multi-stage pump of the aforementioned encapsulated, modular type, which may be either, solely, of a regenerative, turbine type or of a combination centrifugal-turbine type.

Yet another object of the present invention is to afford a novel multi-stage pump of the aforementioned encapsulated, modular type wherein, if desired, the pump may embody a liquid booster for feeding liquid upwardly from a liquid reservoir for discharge by the pump.

A further object of the present invention is to afford a novel multi-stage pump of the aforementioned encapsulated, modular type which is practical and efficient in operation, and which may be readily and economically produced commercially.

Other and further objects of the present invention will be apparent from the following description and claims and are illustrated in the accompanying drawings which, by way of illustration, show the preferred embodiments of the present invention and the principles thereof and what we now consider to be the best mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS DISCLOSED HEREIN

Figure 1:
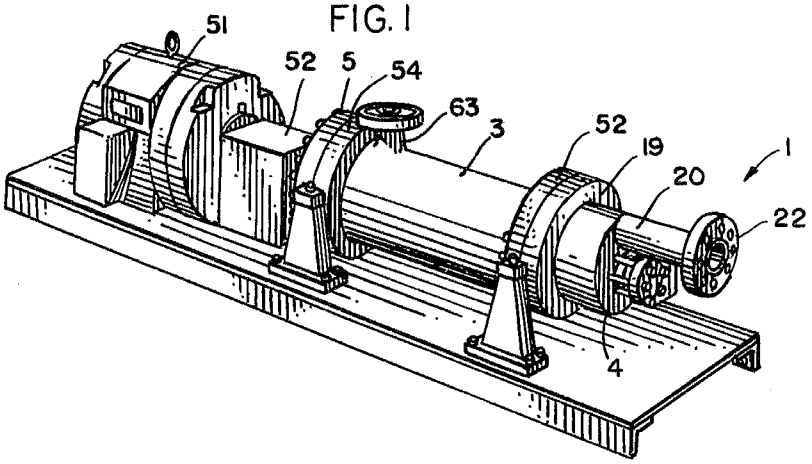
FIG. 1 is a perspective view of a multi-stage pump embodying the principles of the present invention.
Figure 2:
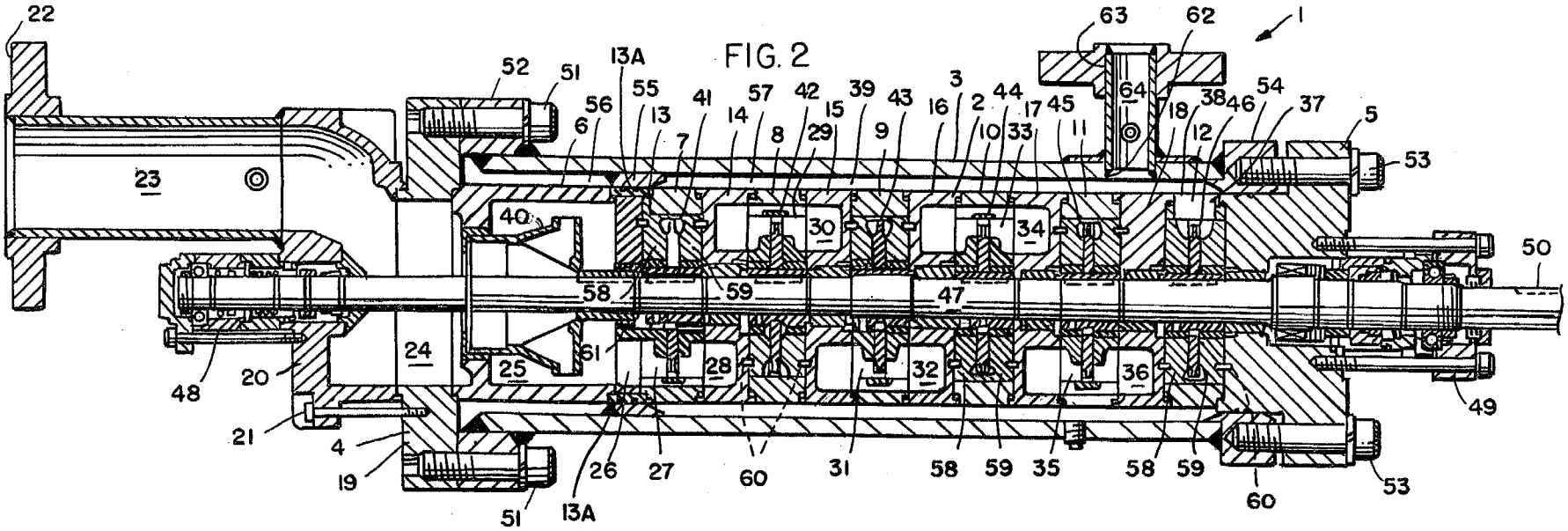
FIG. 2 is a fragmentary, longitudinal sectional view through the pump shown in FIG. 1.

A pump 1, embodying the principles of the present invention, is shown in FIGS. 1 and 2 of the drawings to illustrate the presently preferred embodiment of the present invention.

The pump 1 embodies an elongated, substantially cylindrical-shaped inner housing 2 and an elongated, substantially cylindrical-shaped outer housing 3 disposed in concentric relation to each other between a suction end casing section 4 and an end bell casing section 5, FIG. 2.

The inner housing 2 of the pump 1 embodies a casing ring 6, disposed in abutting, sealed relation to the inner side of the suction end casing 4, and six other casing rings 7–12 disposed in spaced relation to the casing ring 6 and to each other, axially of the housing 2, with the casing ring 12 being disposed is abutting, sealed relation to the inner side of the end bell 5; and an annular transfer plate 13 disposed between the casing rings 6 and 7 in sealed relation thereto, and five other annular transfer plates 14–18 disposed between the casing rings 7 and 8, 8 and 9, 9 and 10, 10 and 11, and 11 and 12, respectively, in sealed relation thereto. The casing rings 6–12 and the transfer plates 13–18 are disposed in axially aligned relation to each other.

The suction end casing section 4 embodies a body portion 19 and a connector portion 20 secured thereto by suitable means such as bolts 21, with the body portion 19 being disposed in the aforementioned abutting, sealed relation to the casing ring 6, and the connector portion 20 being disposed on the side of the body portion 19 remote from the casing ring 6. The connector portion 20 has an outer end 22, with an inlet passageway 23 opening outwardly through the end 22 and extending inwardly therefrom into communication with a passageway 24 in the body portion 19, to afford the inlet portion 23–24 of a passageway which extends longitudinally through the inner housing 2 of the pump 1, and is composed of the aforementioned passageways 23 and 24, a passageway 25 through the casing ring 6, a passageway 26 through the transfer plate 13, a passageway 27 through the casing ring 7, a passageway 28 through the transfer plate 14, a passageway 29 through the casing ring 18, a passageway 30 through the transfer plate 15, a passageway 31 through the casing ring 9, a passageway 32 through the transfer plate 16, a passageway 33 through the casing ring 10, a passageway 34 through a transfer plate 17, a passageway 35 through the casing ring 11, a passageway 36 through the transfer plate 18, and a passageway 37 through the casing ring 12, FIG. 2. The casing ring 12 has an outlet opening or discharge opening 38 extending radially therethrough between the passageway 37 and the annular space 39 between the inner housing 2 and the outer housing 3. During operation of the pump 1, liquid, such as the aforementioned liquified gas or water, or the like, is fed through the passageways 23–38, into the space 39 between the housings 2 and 3 by a centrifugal impeller 40, mounted in the casing ring 6, and six turbine impellers 41–46 mounted in the casing rings 7–12, respectively, as will be discussed in greater detail presently.

A drive shaft 47 extends axially through housings 2 and 3 and is journaled in suitable bearing assemblies 48 and 49 mounted in and secured to the suction end casing section 4 and the end bell 5, respectively. The drive shaft 47 has an end portion 50, which projects outwardly from the bearing assembly 49, by which it may be connected to a suitable prime mover, such as a motor 51, through a suitable connecting unit, such as a transmission 52, FIG. 1.

The suction end casing section 4 is secured to the housing 3 by bolts 51, which extend through a radially, outwardly extending flange 52 mounted on and secured to the adjacent end of the outer housing 3 by suitable means, such as, for example, welding, the bolts 51 being threaded into the body portion 19 of the suction end casing section 4. Similarly, the end bell 5 is secured to the outer housing 3 by bolts 53, which extend therethrough and are threaded into a collar 54 secured to the adjacent end of the outer housing 3 by suitable means such as, for example, welding. With this construction, when the inner housing 2 is disposed in operative position in the outer housing 3, and the suction end casing section 4 and the end bell 5 are secured to the outer housing 3 by the bolts 51 and 53, respectively, the casing rings 6–12 and the transfer plates 13–18 are firmly clamped together between the suction end casing section 4 and the end bell casing section 5 to form the inner housing 2; and the inner housing 2, the casing section 4 and the end bell 5 are firmly, but readily releasably secured to the outer housing 3.

An internal ring or flange 55 is mounted in and secured to the inner periphery of the outer housing 3, by suitable means, such as, for example, welding, in such position that, when the inner housing 2 and the outer housing 3 are disposed in assembled relation to each other, the ring 55 is disposed in abutting, sealed relation to the inner periphery of the outer housing 3 and the outer periphery of the transfer plate 13 by O-rings 13A, to thereby separate the portion 56 of the annular space 39, between the housings 2 and 3, disposed around the casing ring 6, from the remainder 57 of the space 39.

Each of the turbine impellers 41–46 is disposed between a respective pair of liners 58 and 59 mounted in each of the casing rings 7–12, respectively. The liners 58 and 59 are secured to the adjacent ones of the transfer rings 13–18, by suitable fastening members, such as lock pins 60, with the liner 59 in the casing ring 12 similarly secured to the end valve 5 by lock pins 60.

The impellers 40–46 may be secured to the drive shaft 47 for rotation therewith in any suitable manner, but perferably are keyed thereto and secured thereon in the same manner that the impellers are secured to the drive shaft in the afore-mentioned Sieghartner U.S. Pat. No. 3,963,371, by set screws 61.

The outer housing 3 has a discharge outlet 62 extending radially outwardly therethrough at the end thereof remote from the suction end casing section 4, and a discharge connector 63 having a discharge passageway 64 extending therethrough is secured to the outer housing 3 by suitable means, such as, for example, welding, with the passageway 64 disposed in communication with the passageway 62, FIG. 2.

It is to be remembered that the pump 1 is intended to be adapted to pump liquids, such as, for example, liquified gases, at or near the boiling points thereof, as well as other liquids, such as, for example, water. To this end, the first stage of the multi-stage pump 1 of the preferred form of the present invention is a low pressure booster stage, embodying the centrifugal impeller 40 mounted in the casing ring 6, which, in operation, effectively lowers the low "net positive suction head" (N.P.S.H.) rating of the pump in a manner similar to the centrifugal-impeller stage of the pump shown in the earlier Sieghartner U.S. Pat. No. 3,614,256. In the operation of the pump 1, the liquid enters the inlet passageway 23–24 in the suction head casing section 4 and enters the centrifugal impeller 40 in the passageway 25 in the casing ring 6 of the booster stage, or first stage, and is discharged from the periphery of the impeller 40 through the passageway 26 in the transfer plate 13 into the passageway 27 of the casing ring 7 of the adjacent turbine stage, or second stage. The regenerative pumping action of the turbine impeller 41 builds up sufficient pressure to deliver the liquid through the passageway 28 in the transfer plate 14 into the passageway 29 in the casing ring 8 of the next adjacent turbine stage, or third stage. In a similar manner, the liquid passes through the passageways 30, 32, 34 and 36 of the transfer plates 15–18, respectively, and the passageways 31, 33 and 35 of the casing rings 9–11 into the passageway 37 in the casing ring 12, to thus pass through three additional, regenerative stages into the last or seventh stage of the pump 1, afforded by the turbine stage embodying the casing ring 12 and the impeller 46. The regenerative pumping action of the turbine impeller 46 in the casing ring 12 builds up sufficient pressure to deliver the liquid through the opening 38 in the outer periphery of the casing ring 12 into the portion 57 of the annular space 39 between the inner housing 2 and the outer housing 3, from which it is discharged outwardly from the pump 1 through the opening 62 in the outer housing 3 and the passageway 64 in the discharge connector 63. Preferably, each stage of the pump 1 is balanced radially against its adjacent stage by placing the discharges of the successive stages at equal intervals around the shaft 47. It will be seen that, with this construction and mode of operation, the pump 1 is effective to pump various liquids (whether they be in the form of liquified gases or in the form of water, or the like) from the inlet opening 23–24 in the suction end casing section 4 through the passageway 25–38 into the portion 57 of the space 39 between the housings 2 and 3, and outwardly through the opening 62 in the outer housing 3 and the passageway 64 in the discharge connector 63 of the pump 1.

From the foregoing, it will be seen that the casing rings 6–12, together with the parts operatively mounted therein afford individual, respective stages in the pump 1. Thus, the casing ring 6, together with the impeller 40 mounted therein, affords an individual, self-contained booster stage; and the casing rings 7–12, together with the impellers 41–46, mounted therein, respectively, each affords an individual, self-contained regenerative turbine stage.

In addition, it will be seen that the pump 1 is of a modular-type of construction so that individual portions thereof, including complete stages may be readily removed and replaced or may be added to or eliminated from the pump 1. Thus, pumps having a greater or lesser number of stages than those shown in the drawings hereof may be produced without departing from the purview of the broader aspects of the present invention.

From the foregoing, it will be seen that the hydraulic forces generated within the housing 2 of the pump 1 during the operation of the latter are counteracted to a substantial degree by the hydraulic forces in the portion 57 of the space 39, externally of the housing 2. As a result, unlike multi-stage pumps heretofore known in the art, which do not have the two-housing construction afforded by the housings 2 and 3 of the pump 1, the strength requirements for the casing rings 6–12 and transfer plates 13–18 is relatively low. As a result, these parts may be made of cast iron, or the like, rather than the more expensive steel heretofore commonly used therefor. In the construction of the pump 1, the outer housing 3, perferably, is made of steel.

Also, it will be seen that with the external force in the portion 57 of the annular space 39, around the inner housing 2, counteracting to a substantial extent, at least, the internal force within the housing 2, the joints between the various sections of the housing 2, afforded by the casing rings 7–12 and the abutting transfer plates 13–18, are less prone to leakage therebetween, so that the sealing problems are substantially less.

Figure 3:
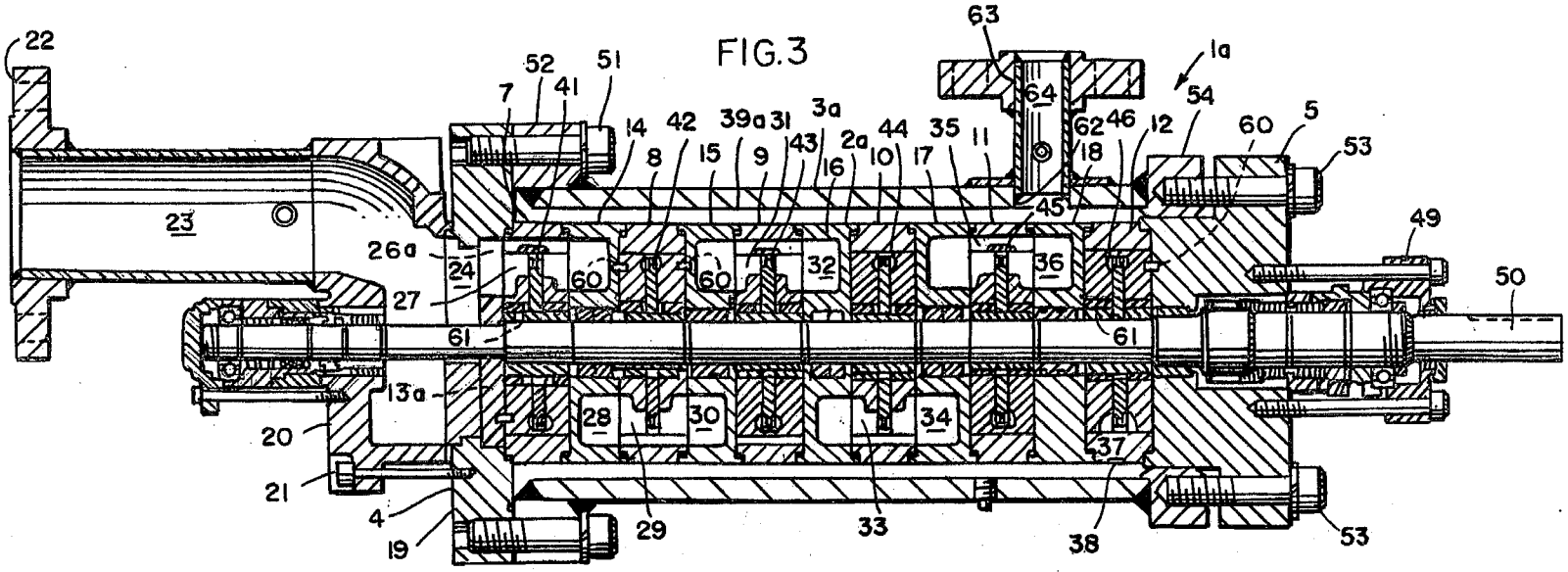
FIG. 3 is a sectional view, similar to FIG. 2, but showing a modified form of the present invention.

A modified form of the present invention is shown in FIG. 3 of the drawings. This modified form of the present invention is similar to the form shown in FIGS. 1–2, except that it does not embody the centrifugal booster impeller 40, and the parts associated therewith in the pump 1 shown in FIGS. 1–2. In FIG. 3, the parts which are the same as in parts shown in FIG. 1–2 are indicated by the same reference numerals, and parts which are similar to parts shown in FIGS. 1–2, but have been substituted therefore, are shown by the same reference numerals with the suffix "a" added thereto.

The pump 1*a*, as shown in FIG. 3, like the pump 1, shown in FIG. 2, embodies six casing rings 7–12 with turbine impellers 41–46 mounted therein, respectively, and with transfer plates 14–18 disposed between adjacent casing rings 7–8, 8–9, 9–10, 10–11 and 11–12, respectively. In the pump 1*a*, a transfer plate 13*a* is disposed on the inlet side of the casing ring 7, in sealed, abutting engagement therewith, and the suction end casing section 19 is disposed in abutting engagement with the outer side of the transfer plate 13*a*.

With this construction of the pump 1*a*, the inner housing 2*a*, of course, is shorter in length than the housing 2, of the pump 1, the booster casing ring 6 having been eliminated and a modified form of transfer plate 13*a* having been substituted for the transfer plate 13. Similarly, the outer housing 3*a* is correspondingly shorter than the outer housing 3, and the sealing ring 55 of the pump has been eliminated therefrom, so that the space 39*a* between the housings 2*a* and 3*a* extends the whole length thereof, between the suction end casing section 4 and the end bell casing section 5. Also, of course, the drive shaft 47*a* is shorter than the drive shaft 47 of the pump 1. Otherwise, the construction of the pump 1*a* is the same as the construction of the pump 1, and the suction end casing section 4 and the end bell 5 are secured to the outer housing 3*a* by bolts 51 and 53, respectively, in position to clampingly hold the modules making up the inner housing 2*a* in assembled relation to each other, in the same manner as the corresponding parts are secured together in the pump 1*a* shown in FIGS. 1–2.

In the operation of the pump 1*a*, the liquid to be pumped is fed through the inlet passage 23–24 directly through the transfer plate 13*a* into the casing ring 7. From the casing ring 7, the liquid is pumped through the passageway 27–38 into the space 39*a* between the housings 2*a* and 3*a*, and outwardly through the opening 62 in the outer housing 3*a* and the passageway 64 in the discharge connector 63 of the pump 1*a*, in the same manner that the liquid is pumped from the passageway 27 in the casing ring 7 outwardly through the connector 63 of the pump 1, shown in FIGS. 1–2.

The pump 1*a*, without the booster stage of the pump 1, affords a highly effective pump for use in installations wherein the net positive suction head available is sufficiently high, such as, for example, two to three feet. Like the pump 1, with the pressure of the liquid in the space 39*a* between the housings 2*a* and 3*a* tending to balance the internal pressure in the housing 2*a*, the casing rings 7–12 and the transfer plates 13*a* and 14–18 may be made of cast iron, or the like, with the outer housing 3*a* preferably being made of steel; and the problem of leakage radially outwardly through the inner housing 2*a* is substantially reduced as compared to pumps of a similar nature heretofor known in the art, but which did not embody an outer housing, such as the housing 3*a*.

Figure 4:
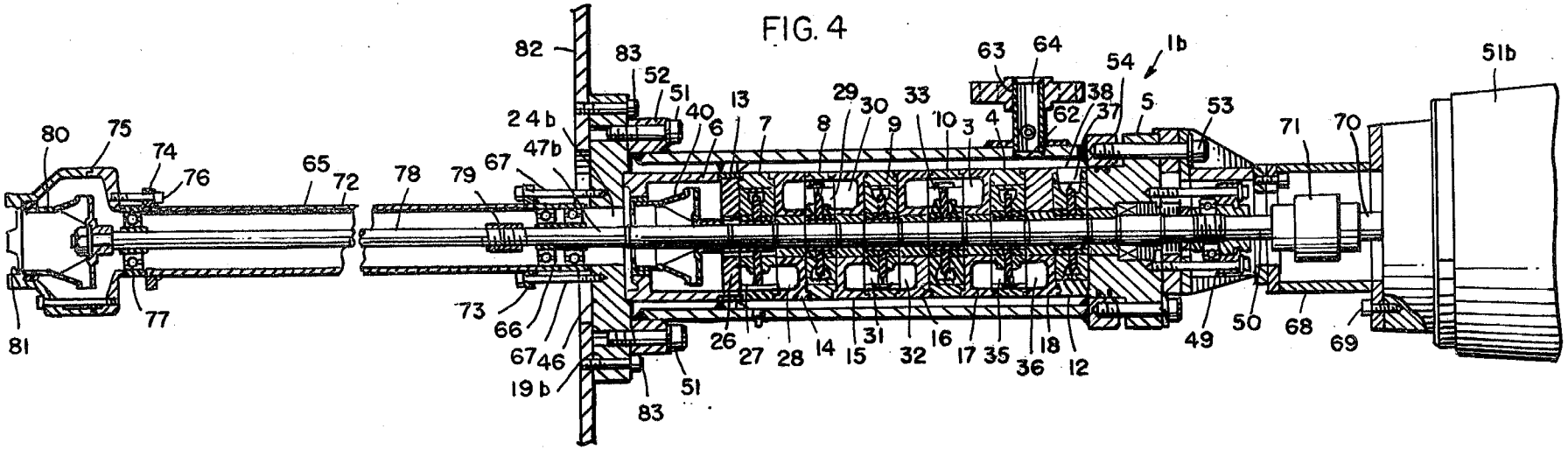
FIG. 4 is a sectional view similar to FIGS. 2 and 3, but showing another modified form of the present invention.
Figure 4:
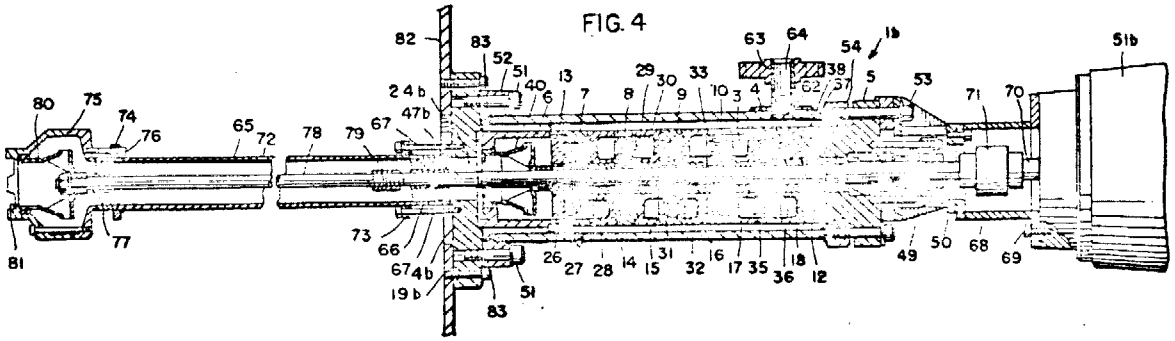

Another modified form of the present invention is shown in FIG. 4 of the drawings, and parts which are the same as parts shown in FIGS. 1–2 are indicated by the same reference numerals, and parts which are similar to parts shown in FIGS. 1–2 but have been substituted therefore, are indicated by the same reference numerals with the suffix "b" added thereto.

The pump 1*b*, shown in FIG. 4 is of a type which is particularly well adapted for use in vertically extending position, for pumping liquid upwardly from a reservoir, or the like. It is of the same general type as the pump shown in U.S. Pat. No. 3,661,474, which issued May 9, 1972 to L. J. Sieghartner, one of the inventors of the present invention, but differs therefrom in that it embodies the principles of the present invention and, particularly, embodies the encapsulating of the inner housing 2 by the outer housing 3. Unlike the pump shown in FIGS. 1–2, the pump 1*b*, embodies an elongated liquid booster device 65 extending from the housings 2 and 3 in substantially axially aligned relation thereto, as will be discussed in greater detail presently.

The pump 1*b* embodies a suction end casing section 4*b* which comprises a body portion 19*b*, which is similar to the body portion 19 of the suction end casing 4 of the pump 1 shown in FIGS. 1–2, except that it is larger in diameter, extending outwardly past the bolts 51, by which it is secured to the flange 52 on the outer housing 3, a greater distance than does the body portion 19 of the pump 1, for a purpose which will be discussed in greater detail presently.

Between the suction end casing section 4*b* and the end bell casing section 5, the pump 1*b* is essentially identical in structure to the pump 1 shown in FIGS. 1–2, except that it embodies a drive shaft 47*b*, which differs from the drive shaft 47 in that it is adapted to be mounted in a suitable bushing assembly 66 secured to the outer face of the suction end casing section 4*b* by bolts 67 instead of in a bearing assembly such as the bearing assembly 48 of the pump 1, shown in FIGS. 1–2. Another difference is that the prime mover for driving the shaft 47*b* of the pump 1*b* comprises a motor 51*b* which is directly mounted, through a suitable mounting bracket or housing 68 to the end bell 5, the mounting bracket 68 being secured to the motor 51*b* by suitable means such as bolts 69 and to the end bell 5 by bolts 53, by which the latter is secured to the flange 54 on the outer housing 3. The end 50 of the drive shaft 47*b*, which projects outwardly from the end bell 5, is directly connected to the drive shaft 70 of the motor 51*b* by a suitable coupling 71.

The liquid booster device 65 embodies an elongated, tubular casing 72, having an outwardly projecting flange 73 on one end thereof, by which the casing 72 is secured to the bearing assembly 66 by the bolts 67.

The casing 72 has another outwardly projecting flange 74 at the other end thereof, and the flange 74 is connected to an impeller housing or shroud 75 by suitable means, such as bolts 76, the flange 74 and the shroud 75 being disposed in operative positions on opposite sides of another bushing assembly 77 in position to retainingly clamp the latter therebetween.

The liquid booster device 65 embodies a drive shaft 78, which extends axially through the casing 72 and is secured at one end to the drive shaft 47*b*, for rotation therewith, by a coupling 79, the other end portion of the drive shaft 78 being journaled in the bushing assembly 77 and projecting therefrom into the shroud 75. A centrifugal impeller 80 is secured to the end portion of the drive portion 78, which is disposed in the shroud 75, and is rotatable thereby.

Like the pumps 1 and 1*a*, the pump 1*b* is intended to be adapted to pump liquids, such as, for example, liquified gases, at or near the boiling points, as well as other liquids, such as, for example, water. In the operation of the pump 1*b*, the liquid is pumped in through the inlet 81 of the shroud 75 by the impeller 80 and is fed upwardly through the casing 72 to the inlet passageway 24*b* in the suction end casing section 4*b*. To this end, the impeller 80 can be of any number of known impeller designs that will ease the liquid into motion and drive it up to the inlet 24*b*. The criteria in selecting the impeller 80 is that it should have a low disturbance on the liquid at or near the boiling point (i.e. low pressure creating characteristics) so that the liquid will not be vaporized prior to entering the inlet 24*b*. A suitable impeller design which would be used for impeller 80 is disclosed in U.S. Pat. No. 2,875,698 to Leo C. Roth, which is assigned to the same assignee as this invention. Also, as will be appreciated by those skilled in the art, if desired, a plurality of impeller, like the impeller 80, may be spaced along the casing 72, as disclosed in the aforementioned Sieghartner U.S. Pat. No. 3,661,479 without departing from the purview of the present invention.

In the use of the pump 1*b*, the latter may be mounted on the top of a reservoir or a liquid storage tank, such as the tank top 82, shown in FIG. 4, by suitable means such as bolts 83 extending through the body portion 19*b* of the suction end casing section 4*b*, outwardly of the bolts 51 by which the latter is secured to the outer housing 3.

In the operation of the pump 1*b*, the inlet opening 81 in the shroud 75 is submerged in the liquid to be pumped and liquid enters therethrough into the shroud 75 where it is smoothly stirred into motion and pushed up the casing 72 to the inlet passageway 24*b* by the impeller 80. From the passageway 24*b*, the liquid enters the centrifugal impeller 40 in the passageway 25 in the casing ring 6 and is discharged from the periphery of the impeller 40 through the passageway 26 in the transfer plate 13 into the passageway 27 of the casing ring 7 of the adjacent turbine stage. From there the regenerative pumping action of the turbine impellers 41–46 builds up sufficient pressure to deliver the liquid through the passageway 28–38 into the portion 57 of the space 39 between the inner housing 2 and the outer housing 3, from which it is discharged outwardly from the pump 1*b* through the opening 62 in the outer housing 3 and the passageway 64 and the discharge connector 63 in the same manner as heretofore discussed with respect to the pump 1, shown in FIGS. 1–2.

From the foregoing, it will be seen that the pump 1*b* affords a novel, and highly practical pump for pumping liquids upwardly from a reservoir or holding tank, or the like.

In addition, it will be seen that the pump 1*b* affords a practical pump for handling liquids, such as, for example, liquified gases, at or near the boiling points, as well as other liquids, such as, for example, water.

In addition, it will be seen that pump 1*b* embodies the novel encapsulated, modular construction of the pump 1, with the attendant advantages heretofore discussed with respect to the latter.

From the foregoing, it will be seen that the present invention affords a novel multi-stage pump.

Also, it will be seen that the present invention affords a novel multi-stage pump embodying a novel encapsulated, inner housing construction.

In addition, it will be seen that the present invention affords a novel multi-stage pump of the aforementioned type which is practical and efficient in operation and which may be readily and economically produced commercially.

Thus, while we have illustrated and described the preferred embodiments of our invention, it is to be understood that these are capable of variation and modification, and we therefore do not wish to be limited to the precise details set forth, but desire to avail ourselves of such changes and alterations that fall within the purview of the following claims.

We claim:

1. A multi-stage pump comprising
   a. an elongated inner housing including a low pressure section and high pressure section having a plurality of stages disposed in side by side relation to each other from one end of said housing to the other end thereof; said low pressure section includes a booster stage having low pressure creating characteristics and said high pressure section includes a plurality of stages having high pressure creating characteristics
   b. said inner housing having
      (1) a fluid inlet at one end thereof adjacent to said low pressure section,
      (2) a fluid outlet at the other end thereof,
   c. an outer housing having a barrel member disposed around said inner housing in substantially concentric relation thereto, and said outer housing defining, with said inner housing, a closed annular space between said inner and outer housing, and
   d. sealing means disposed in sealing engagement with said outer housing and said inner housing, between said low pressure section and said high pressure section adjacent thereto, for sealing off the portion of said annular space disposed radially to said low pressure section from the annular space dispose radially to said high pressure section,
   e. discharge outlet means through said outer housing including said annular space disposed radially to said high pressure section, for receiving fluid from said fluid outlet in said inner housing, and for discharging same from said pump.

2. A multi-stage pump as defined in claim 1, and in which
   a. said inner housing comprises
      (1) casing rings disposed in spaced relation to each other longitudinally of said inner housing, and
      (2) transfer plates disposed on opposite sides of each of said casing rings in abutting engagement therewith.

3. A multi-stage pump as defined in claim 1, and which includes
   a. an elongated remote liquid booster device mounted on said one end of said outer housing for delivering a liquid upwardly from a liquid reservoir to said fluid inlet.

4. A multi-stage pump as described in claim 1 wherein said sealing means includes an internal ring extending about the inner periphery of the barrel member of said outer housing and the outer diameter of said inner housing in abutting sealed relation.

5. A multi-stage pump as defined in claim 1, and
   a. which said outer housing includes
      (1) a suction end casing section
         (a) mounted on said one end of said inner housing, and
         (b) having an inlet passageway extending therethrough and disposed in communication with said fluid inlet,
      (2) an end bell mounted on said other end of said inner housing, and further comprises
      (3) a drive shaft journaled in said casing section and said end bell for rotation therein, and extending substantially axially through said inner housing, and
      (4) impellers mounted on said drive shaft, in spaced relation to each other longitudinally of said drive shaft, for rotation with said drive shaft, and
   b. in which
      (1) said stages include
         (a) casing rings disposed in spaced relation to each other longitudinally of said inner housing, and
         (b) transfer plates disposed on opposite sides of each of said casing rings in abutting engagement therewith, and
      (2) each of said impellers is disposed in a respective one of said casing rings.

6. A multi-stage pump as defined in claim 5, and in which
   said high pressure portion includes a plurality of regenerative, turbine impeller stages.

7. A multi-stage pump as defined in claim 5, and in which
   said low pressure portion includes a centrifugal booster impeller.

8. A multi-stage pump as defined in claim 7, and in which
   a. the remainder of said impellers comprises regenerative, turbine impellers of said high pressure portion.

9. A multi-stage pump as defined in claim 5, and in which
   a. each of said casing rings and each of said transfer plates comprises an individual, separate member disposed around said drive shaft, and
   b. said suction end casing section and said end bell are releasably secured to said barrel member of said outer housing in position to clamp said casing rings and transfer plates together.

10. A multi-stage pump as defined in claim 9, and in which
   a. said casing section and said end bell are bolted to said barrel member of said outer housing.

11. A regenerative turbine pump comprising
   a. an elongated inner housing having a plurality of stages including a low pressure section and a high pressure section disposed in side by side relation to each other from one end of said housing to the other end thereof, said low pressure section including a centrifugal booster impeller stage and said high pressure section includes a regenerative turbine impeller stage, said inner housing having
      (1) a first fluid inlet at one end, and
      (2) a fluid outlet at the other end, and
   b. an outer housing having
      (1) opposite end portions sealed to said inner housing,
      (2) an intermediate portion, disposed between said end portions, and extending around said inner housing in spaced relation thereto to define therewith a closed fluid chamber, and
   c. sealing means disposed in sealing engagement with said outer housing and said inner housing, between said low pressure section and said high pressure section adjacent thereto, for sealing off the portion of said annular space disposed radially around said low pressure section from the annular space disposed radially to said high pressure section
   d. said first fluid outlet being in communication with said fluid chamber for feeding fluid from said inner housing into said fluid chamber in said outer housing, for passage outwardly through said second fluid outlet.

12. A regenerative turbine pump as described in claim 11 wherein said sealing means includes an internal ring extending about the inner periphery of the intermediate portion of said outer housing and the outer diameter of said inner housing in abutting sealed relation.

13. A regenerative turbine pump as defined in claim 11, and which includes a. a liquid booster device mounted on said one end of said outer housing for delivering a liquid upwardly from a liquid reservoir to said fluid inlet.

14. A regenerative turbine pump as defined in claim 13, and in which a. said booster device comprises
   (1) a tubular casing mounted on said one end of said outer housing
      (a) in communication with said fluid inlet, and
      (b) in substantially axial alignment with said inner housing, and
   (2) impeller means mounted in the end of said casing remote from said inner housing for feeding liquid through said casing toward said fluid inlet from such a reservoir.

15. A regenerative turbine pump as defined in claim 11, and which includes a. a drive shaft rotatably mounted in said inner housing in substantially axial relation thereto, and
b. a plurality of impellers fixed to said drive shaft for rotation therewith in spaced relation to each other axially of said inner housing.

16. A regenerative turbine pump as defined in claim 15, and a. which includes
   (1) a liquid booster device mounted on said one end of said outer housing for delivering a liquid upwardly from a liquid reservoir to said fluid inlet and
b. in which
   (1) said booster device comprises
      (a) a tubular casing mounted on said one end of inner housing
         (1') in communication with said fluid inlet, and
         (2') in substantially axial alignment with said inner housing,
      (b) another drive shaft
         (1') rotatably mounted in said casing in substantially axial relation thereto, and
         (2') coupled to said first mentioned drive shaft for rotation therewith, and
      (c) an impeller mounted on said other drive shaft for rotation therewith in the end of said casing remote from said inner housing for feeding fluid from such a reservoir inwardly through said one end of said casing and outwardly through the other end of said casing into said fluid inlet.

17. A regenerative turbine pump as defined in claim 15 or 16, and in which a. the one of said impellers of said inner housing disposed closest to said fluid inlet comprises a centrifugal, booster impeller, in said low pressure portion, and
b. the remainder of said impellers of said inner housing comprise regenerative, turbine impellers in said high pressure portion.

18. A regenerative turbine pump as defined in claim 17, and in which a. said impeller mounted on said drive shaft of booster device comprises a centrifugal, booster impeller having low pressure creating characteristics.

19. A multi-stage regenerative turbine pump comprising a. an inner housing having
   (1) a plurality of successive stages including a centrifugal, booster impeller stage having low pressure creating characteristics and successive regenerative turbine impeller stages having high pressure creating characteristics, each of said stages having a casing ring.
   (2) transfer plates in intermediate abutting relation to respective adjacent pairs of said casing rings
b. each of said transfer plates having fluid passageway means providing
   (1) an inlet communicating with the interior of the next adjacent earlier-stage casing ring, and
   (2) an outlet communicating with the interior of the next adjacent later-stage casing ring,
c. a suction end casing section abutting the first-stage casing ring,
d. an end ball casing section abutting the last-stage casing section,
e. a barrel housing mounted between said suction end casing section and said end bell casing section in outwardly spaced relation to said inner housing defining a closed annular space,
f. means defining a passageway through said suction end casing section into said first stage casing ring,
g. means defining a passageway from said last-stage casing ring into the annular space between said housings,
h. sealing means disposed in sealing engagement with said outer housing and said inner housing, between said centrifugal, booster stage and the regenerative turbine stage next adjacent thereto, for sealing off the portion of said annular disposed radially to said centrifugal booster impeller stage from the annular space disposed radially to said regenerative turbine impeller stages,
i. said barrel housing having an outlet passageway therethrough, for discharging fluid leaving the outlet of said inner housing and fluid from said annular space,
j. an elongated drive shaft rotatably mounted in and extending axially through said inner housing, and
k. a plurality of impellers,
l. each of said impellers being disposed in a respective one of said casing rings and secured to said shaft for rotation therewith.

20. A multi-stage regenerative turbine pump as described in claim 19 wherein said sealing means includes an internal ring extending about the inner periphery of the barrel housing and the outer diameter of said inner housing in abutting sealed relation.

21. A multi-stage regenerative turbine pump as defined in claim 19, and in which a. said casing rings and said transfer plates are made of cast iron, and
b. said outer housing is made of steel.

22. A multi-stage regenerative turbine pump as defined in claim 21, and in which a. said casing sections are releasably secured to respective opposite ends of said barrell housing in position to clamp said casing rings and transfer plates together in substantially axially-aligned relation to each other.

* * * * *

UNITED STATES PATENT AND TRADEMARK OFFICE

CERTIFICATE OF CORRECTION

PATENT NO. : 4,299,536

DATED : November 10, 1981

INVENTOR(S) : Leonard J. Sieghartner & Larry Barnhouse

It is certified that error appears in the above—identified patent and that said Letters Patent is hereby corrected as shown below:

Col. 4, line 21: delete "valve", insert --bell--

Col. 12, line 23: delete "ball", insert --bell--

Cancel Fig. 4 of the drawings and substitute the attached Fig. therefor.

Signed and Sealed this

*Eleventh* Day of *May 1982*

[SEAL]

*Attest:*

GERALD J. MOSSINGHOFF

*Attesting Officer*

*Commissioner of Patents and Trademarks*